US005321929A

United States Patent [19]

Hanevold et al.

[11] Patent Number: 5,321,929

[45] Date of Patent: Jun. 21, 1994

[54] APPARATUS FOR POSITIONING ARTICLES IN BOXES OR CRATES

[75] Inventors: Geir Hanevold, Asker; Tore Planke, Osco, both of Norway

[73] Assignee: Tomra Systems A/S, Drammensveien, Norway

[21] Appl. No.: 959,269

[22] Filed: Oct. 9, 1992

[51] Int. Cl.[5] ..... B65B 5/10; B65B 21/10

[52] U.S. Cl. ..... 53/246; 53/250; 53/475

[58] Field of Search ..... 53/475, 473, 244, 246, 53/248, 250, 249

[56] References Cited

U.S. PATENT DOCUMENTS

| | | | |
|---|---|---|---|
| 798,609 | 9/1905 | Lassig et al. | 53/246 |
| 3,080,033 | 3/1963 | Scott et al. | 53/246 X |
| 3,862,536 | 1/1975 | Litchfield | 53/246 |
| 4,056,920 | 11/1977 | Shields | 53/246 X |
| 4,594,837 | 6/1986 | Zielke | 53/250 X |
| 4,722,169 | 2/1988 | DeSantis | 53/475 X |
| 5,138,822 | 8/1992 | Velge | 53/475 X |

*Primary Examiner*—James F. Coan

[57] ABSTRACT

A system for positioning of articles in a box or crate means, said box or crate means positionable on table means being selectively shiftable in two horixontal x, y directions through indexed motion and said articles being controllably supplied through chute means from above into said box or crate means at proper x, y positions of said table means relative to said chute means. Means are provided for delivering said box or crate means from a stack chute means capable of holding a stack of box or crate means.

6 Claims, 9 Drawing Sheets

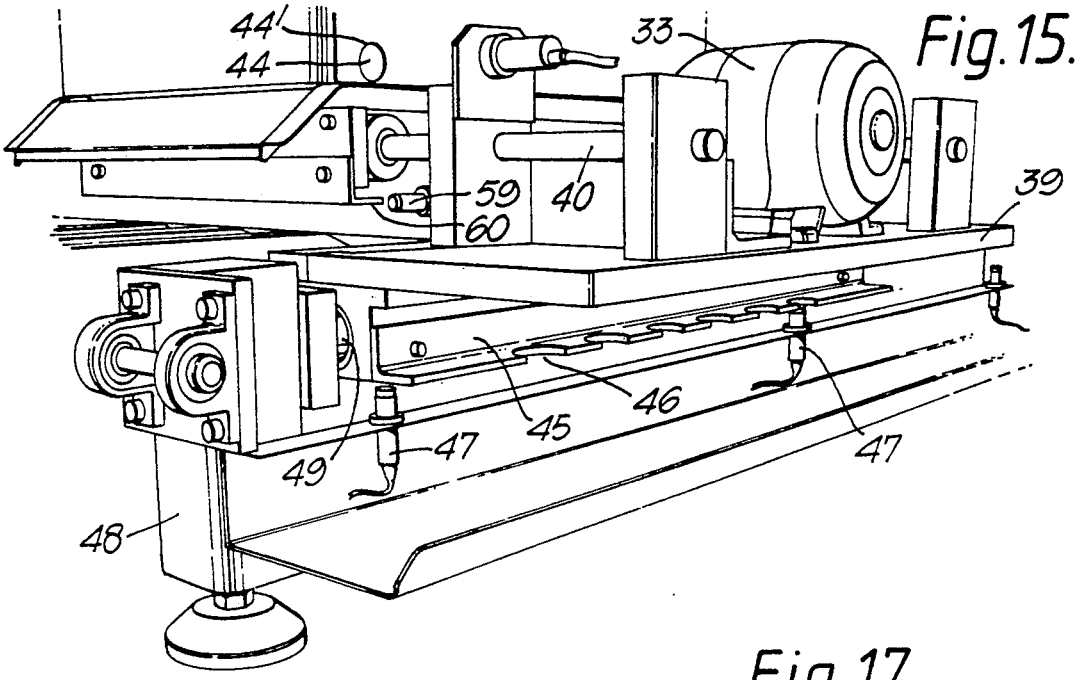
Fig.15.
Fig.17.
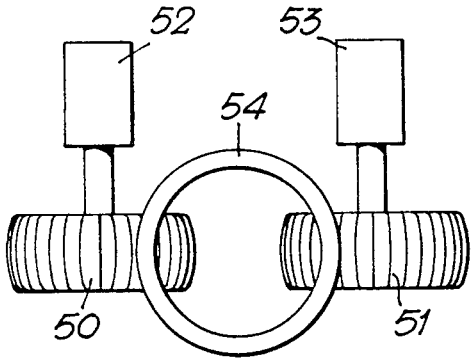
Fig.16.
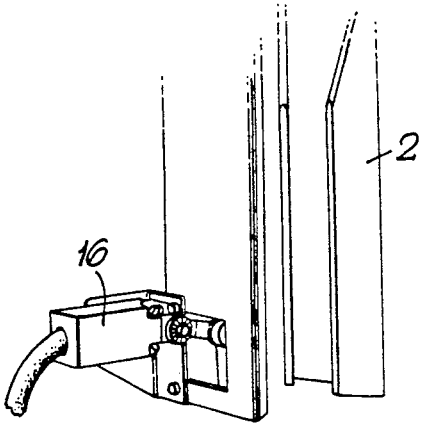
Fig.18.
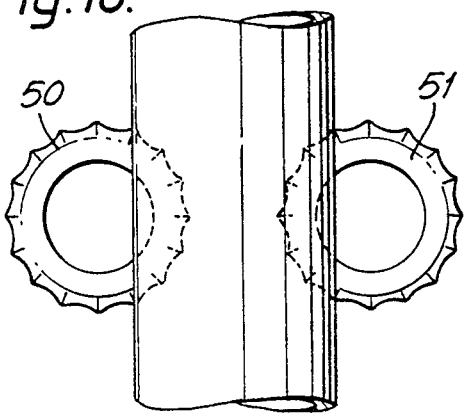

APPARATUS FOR POSITIONING ARTICLES IN BOXES OR CRATES

The present invention relates to a method and a device for positioning of articles in a box or crate means.

In prior art systems such a positioning of articles has been made by clamping a number of articles between two or more clamp members and position articles from above into a box, thus filling the box fully or partly through such step. When positioning e.g. bottles in a crate, grip means are brought in touch with the top of each bottle to be positioned in the crate. However, such means for moving bottles into a crate are complex and expensive and are mostly suitable in a brewery installation.

Further, it is known to position bottles in a crate in steps of four or six bottles at the time, gripper means clamping the number of bottles to enter the crate at one time and positioning the bottles in the crate, whereupon the clamping arms return to collect further bottles to enter the crate.

The present invention, however, has as an object to provide a method and a device for positioning of articles in a box or crate means, however, avoiding gripper means based on mechanical gripping, clamping or suction. Although the present method and device is to be explained in particular in connection with reusable bottles to be positioned in a box or crate means, it will be appreciated that this is only a preferred embodiment and example of the present invention, and is only intended to explain the concepts of the present invention.

According to a first embodiment of the method, according to the invention, the method comprises the steps of a ) locating said box or crate means on a table means indexable in two horizontal directions x and y, b ) forwarding the articles to chute means located above said box or crate means, c) positioning by indexing said table means so as to locate said chute means above a first x,y coordinate of said table means, d) selectively feeding an article through said chute means to position said article in said box or crate means below said chute means, e) positioning by indexing said table means so as to locate said chute means above a further x, y coordinate of said table means, f) selectively feeding a further article through said chute means to position said article in said box or crate means below said chute means, and g) repeating steps e) and f) until said box or crate is properly filled by said articles.

Said step a) includes, according to a further feature of the method feeding of said box or crate means from a stack of box and crate means.

Suitably, said method includes, according to a further embodiment of the invention, recognizing of an identity of an article, forwarding said article onto a conveyor means, selecting articles from said conveyor means, and forwarding said selected articles to said chute means located above said box or crate means.

In the process of passing through said chute means, said article is suitably subjected to retardation means causing said article to be moved to said box or crate means at speed substantially inhibiting bouncing of said article when reaching said box or crate means.

The device for positioning of articles in a box or crate means, according to the invention, comprises a) a table means indexable in two horizontal directions x and y, said box or crate means being positionable on said table means, b) drive means for selectively indexing said table means, c) means for forwarding the articles to chute means located above said box or crate means when on said table means, d) means for positioning by indexing said table means so as to locate said chute means above a first x, y coordinate of said table means, e) means for selectively feeding an article through said chute means to position said article in said box or crate means below said chute means, f) means for positioning by indexing said table means so as to locate said chute means above a further x, y coordinate of said table means, and g) means for selectively feeding further articles through said chute means to position said articles in said box or crate means below said chute means at respective x, y coordinates of said table means until said box or crate is properly filled with said articles.

Further, said device includes means for holding a stack of boxes or crate means, means for dislocating and removing a bottom box or crate means from said stack, and means for forwarding said removed box or crate means to said table means.

Further, said device may include, prior to said chute means, means for recognizing an identity of an article, conveyor means for forwarding said article to selective gate means, and means for forwarding said articles from said gate means to said chute means located above said box or crate means when on said table means.

Said means for holding comprises suitably a stack chute, said stack chute having at a rear end thereof dislocating and pushing members acting on a box or crate means rear wall when said box or crate means drops from a position above a further box or crate means below which is removed from the stack bottom, in order to enable said box or crate means to enter the stack bottom position and previously held by said further box or crate means out of horizontally locking engagement with a another box or crate means located above, and said stack chute having at a front end thereof an opening so wide and high as to cause said box or crate means in so dropping to tilt with its forward bottom part in a forward direction simultaneously with a pushing action of said members, and further having a drive means for engaging a rear end of said box or crate means for selective removal thereof from said stack chute.

Further, said device suitably includes retainer means for retaining said box or crate means in said chute until selectively removed therefrom.

Said means for selectively pushing includes, according to the invention, a reciprocally movable pusher member capable of pushing a first article off said conveyor means, while barring a subsequent article from moving until said first article has been pushed towards said chute means.

Said means for positioning said table means include, according to the invention, x and y location members attached to said table means, said members having along the length thereof indentations corresponding to said x and y values, respectively, of said x, y coordinates, said indentations being cooperative with sensor means for indexing said table means to locate said table means at proper coordinates with respect to said chute means.

The invention is now to be described with reference to the drawing figures showing preferred, but non-limitative examples of the invention.

Figure 4A:
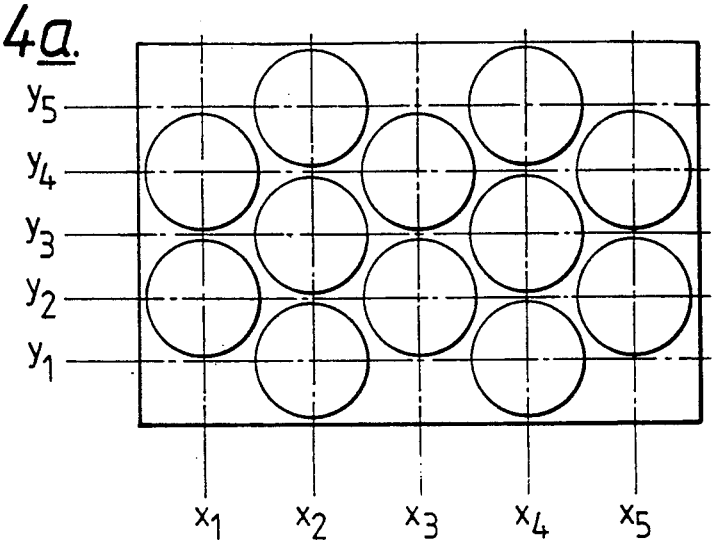
Figure 4B:
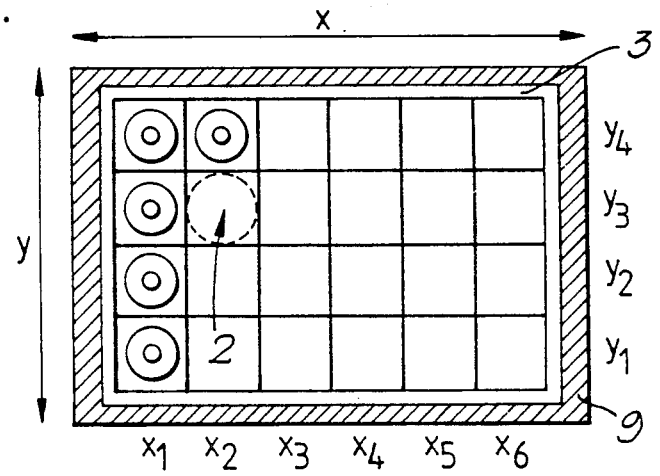

FIGS. 4*a* and 4*b* illustrate movability of a crate located on a table which is movable in horizontal x and y directions.

Figure 3:
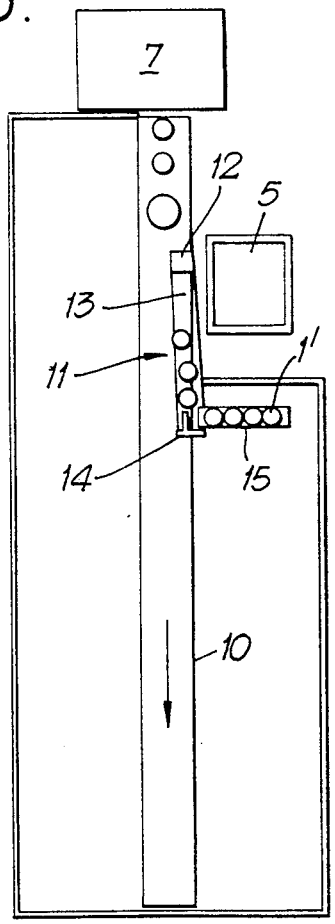
FIG. 3 illustrates the embodiment of FIG. 2 from above.
Figure 5:
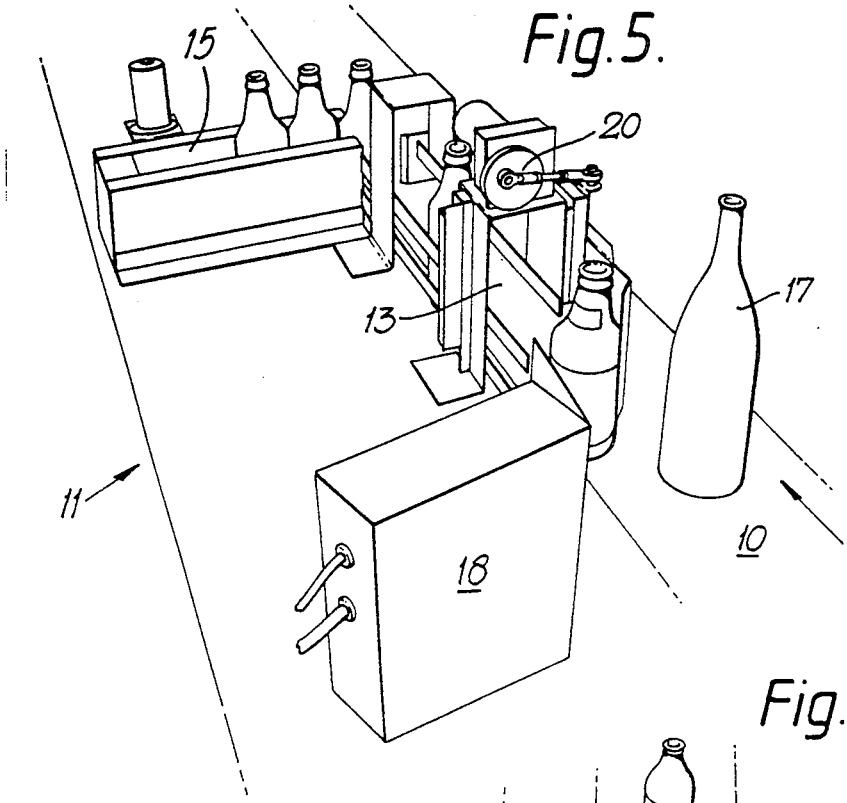

FIG. 5 is a more detailed view of the embodiment in FIG. 3 seen in perspective view from the inlet side thereof.

Figure 6:
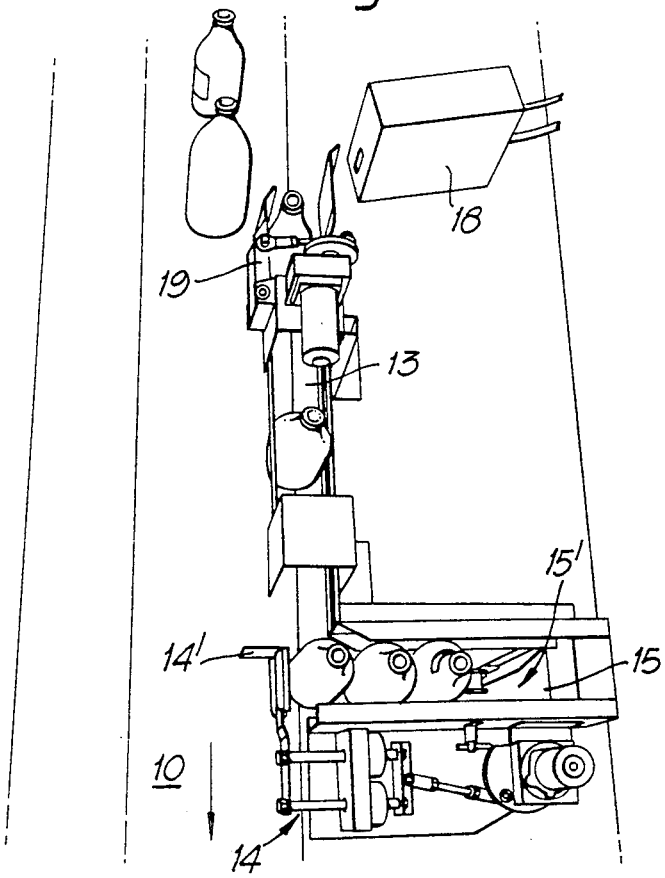

FIG. 6 is a top perspective view in more detail of the embodiment in FIG. 3.

Figure 7:
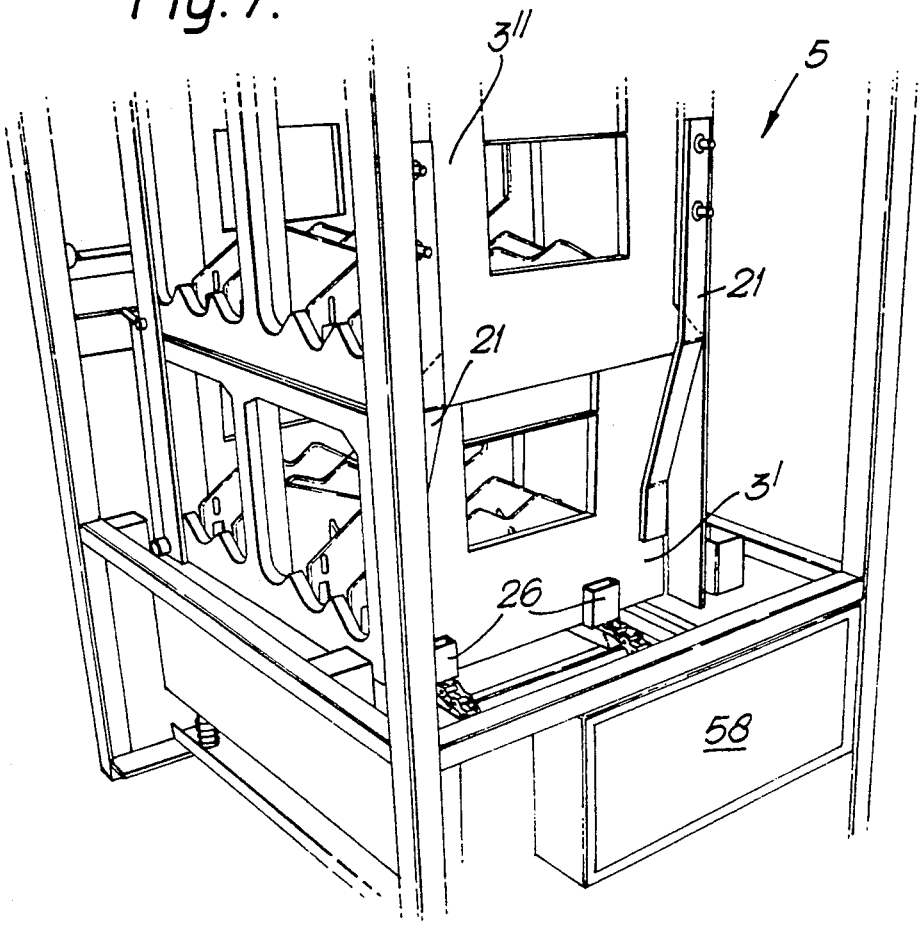

FIG. 7 is a bottom view of a crate stack chute according to the invention.

Figure 8:
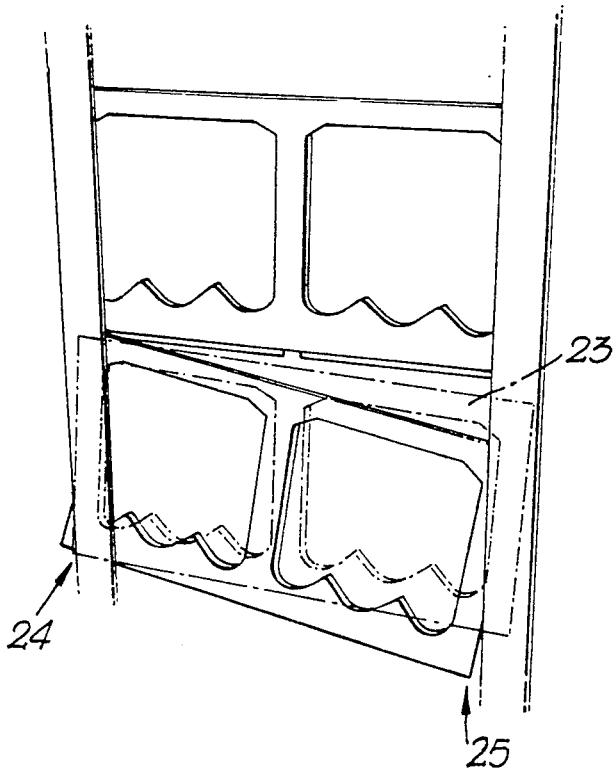

FIG. 8 is a sketch illustrating a movement of a bottom crate in a stack.

Figure 9:
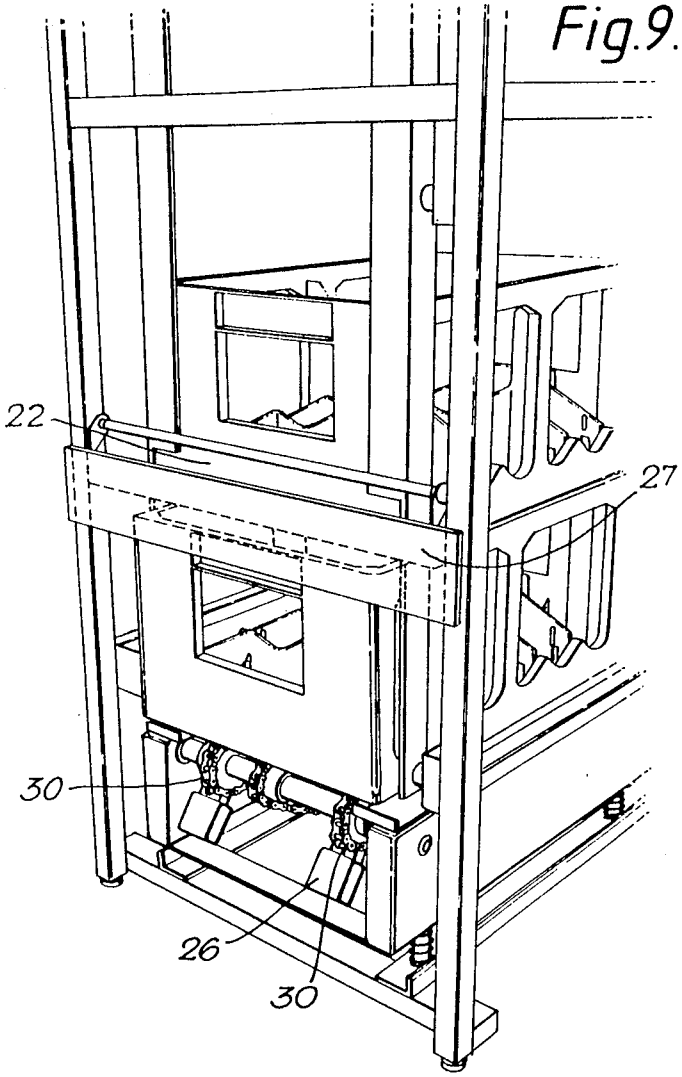

FIG. 9 illustrates a stack of crates.

Figure 10:
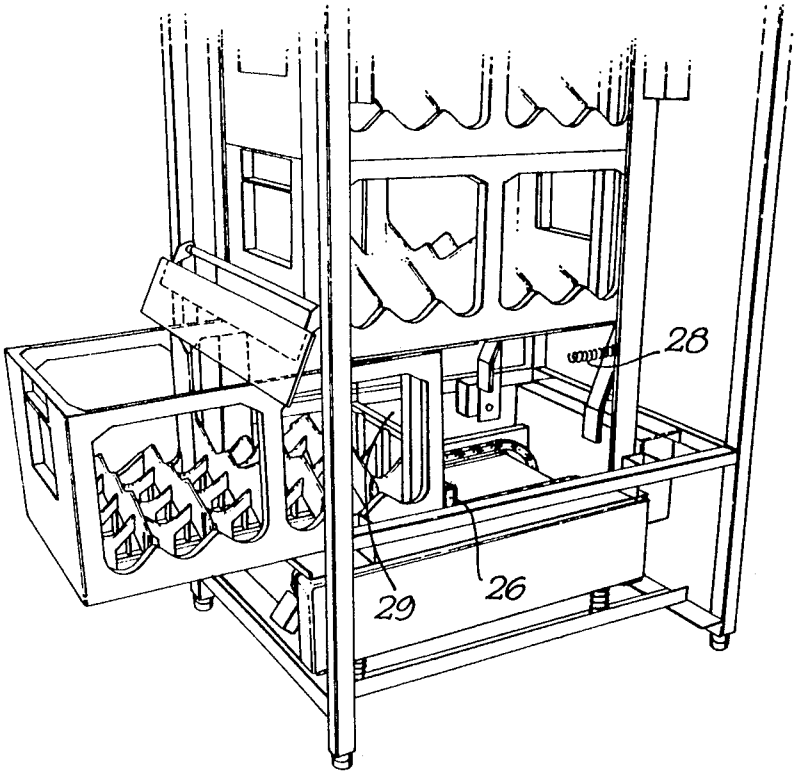

FIG. 10 illustrates removal of a bottom crate from a stack of crates.

Figure 11:
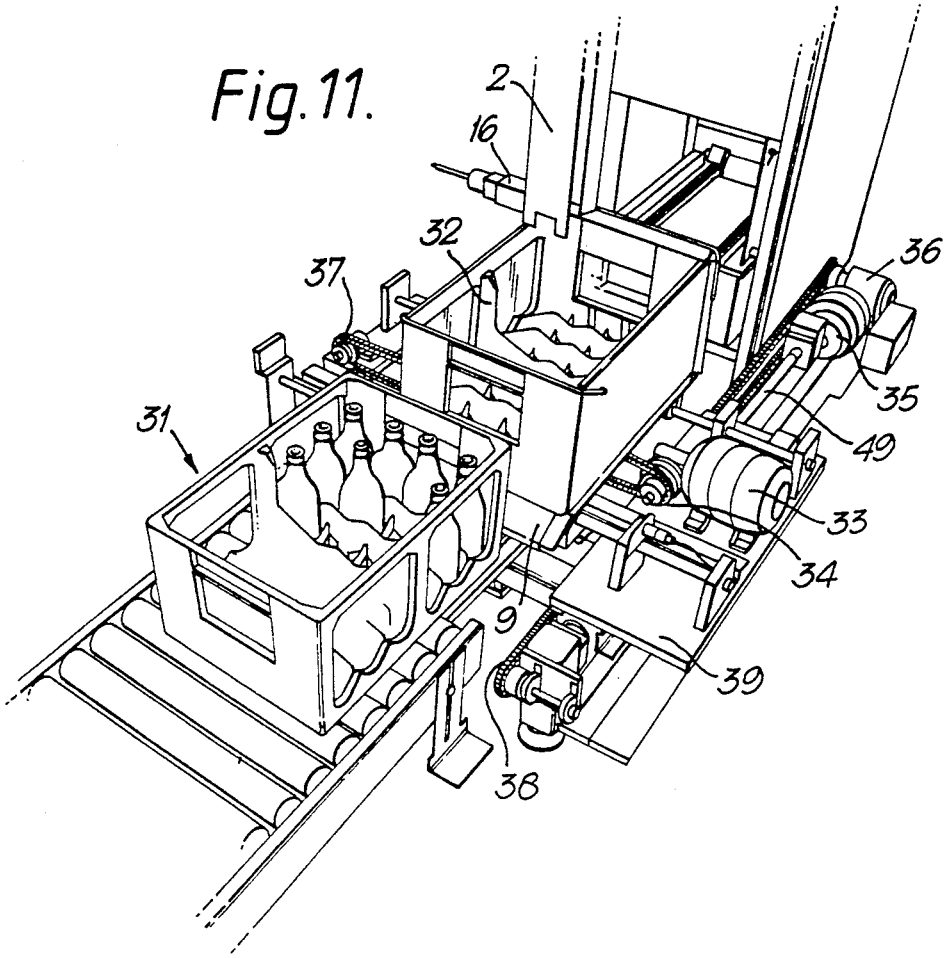

FIG. 11 is a first perspective view of a crate table section of the device, according to the invention.

Figure 12:
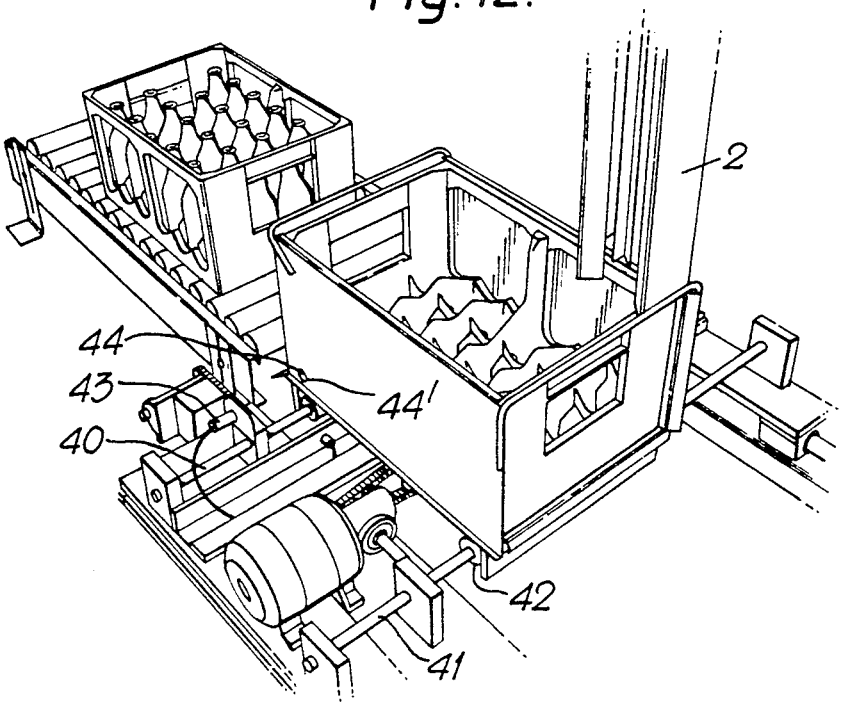

FIG. 12 is a further perspective view of the embodiment in FIG. 11.

Figure 13:
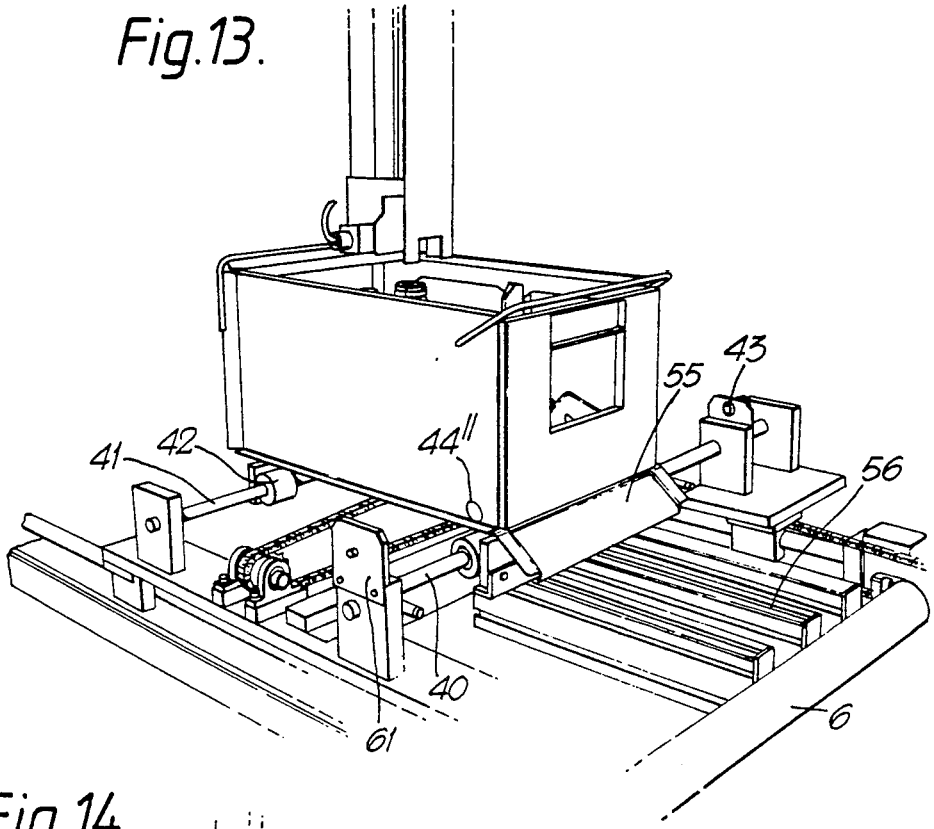

FIG. 13 is a view, from the other side, of a part of the embodiment in FIG. 11.

Figure 14:
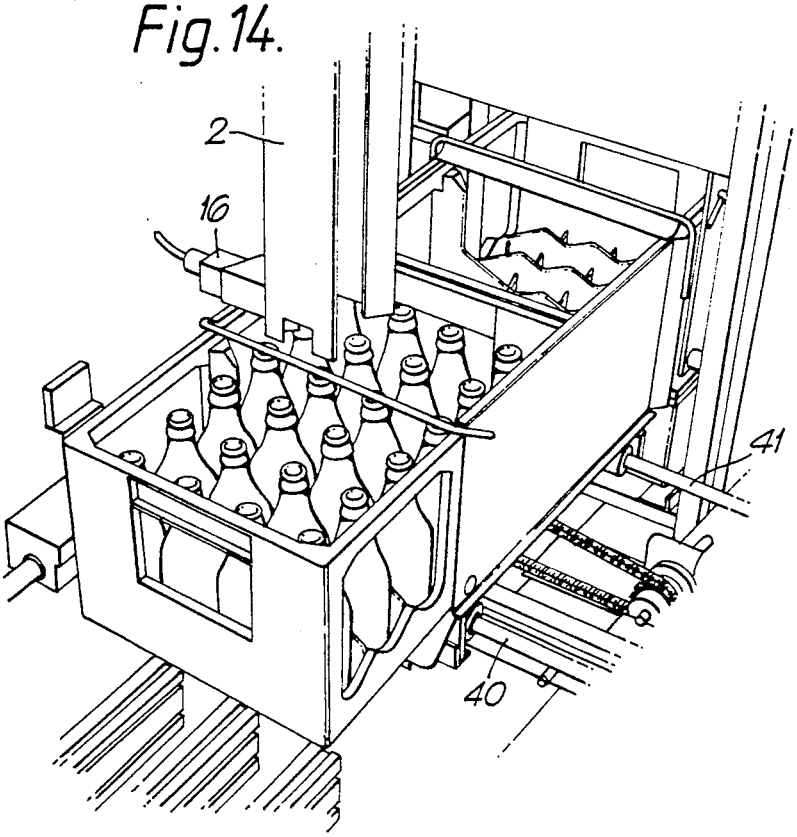

FIG. 14 illustrates pushing out of a full crate and entering an empty crate on the table, according to the invention.

FIG. 15 illustrates a means for indexing the table, according to the invention.

FIG. 16 indicates means for sensing the passing of a bottle in a chute means.

FIGS. 17 and 18 illustrate a bottle speed retardation means, as seen from above and in side view, respectively.

Figure 19:
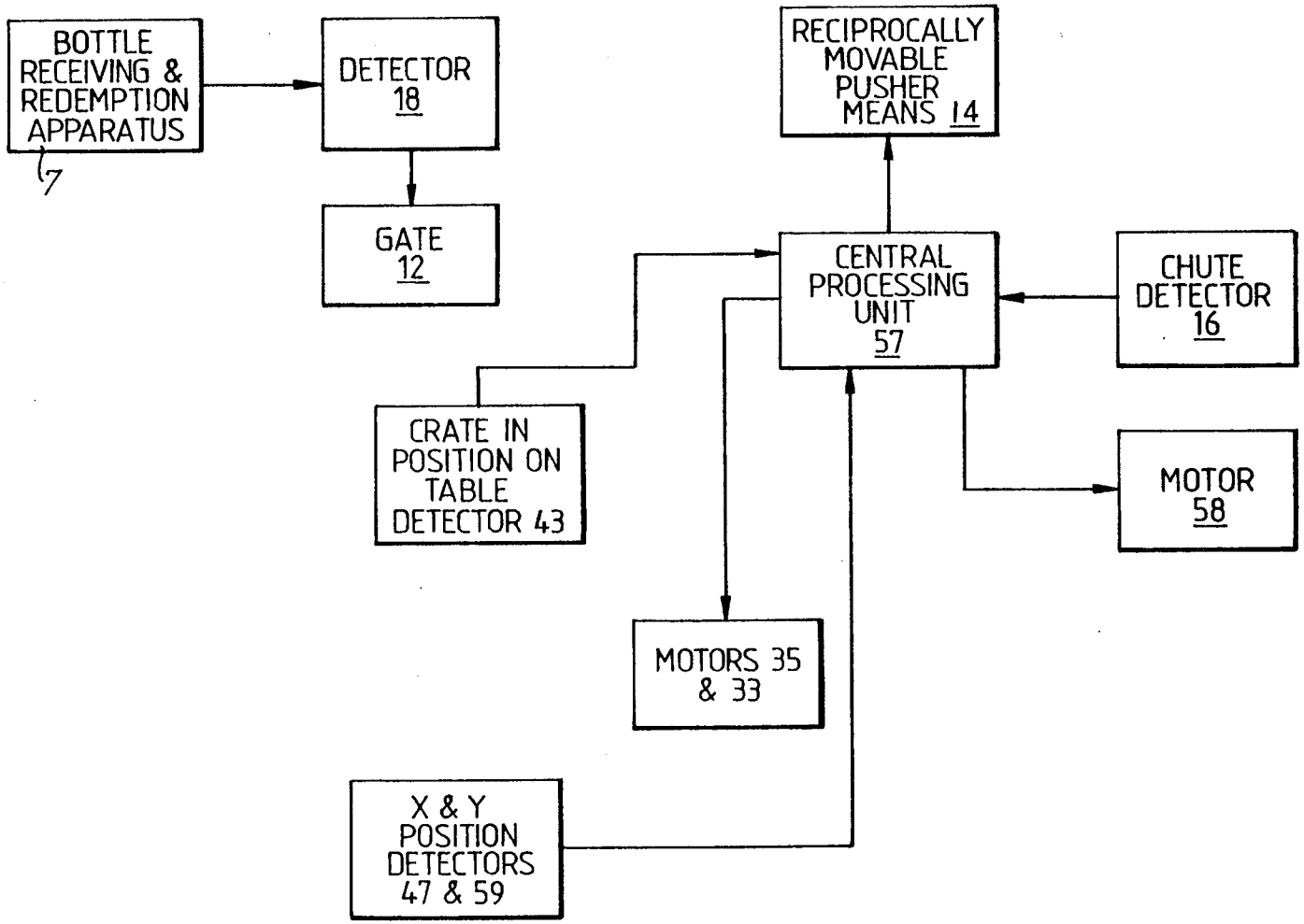

FIG. 19 is a block schematic diagram over the principal elements of the device, according to the invention.

Figure 20:
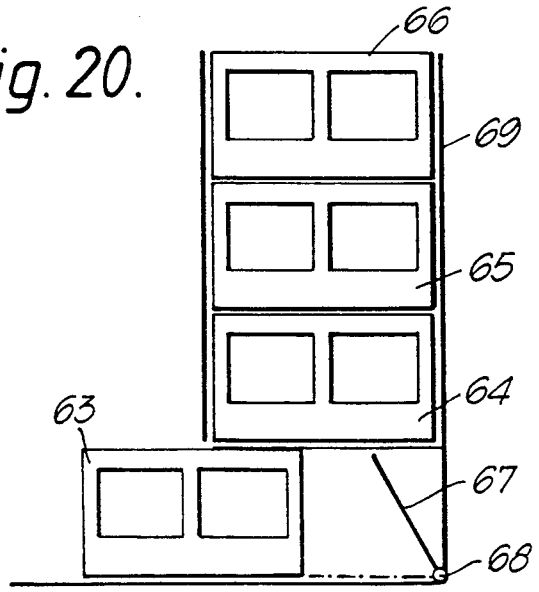

FIG. 20 shows schematically a modification of a crate stack chute.

The invention is now to be described in further detail with reference to the drawings.

Figure 1:
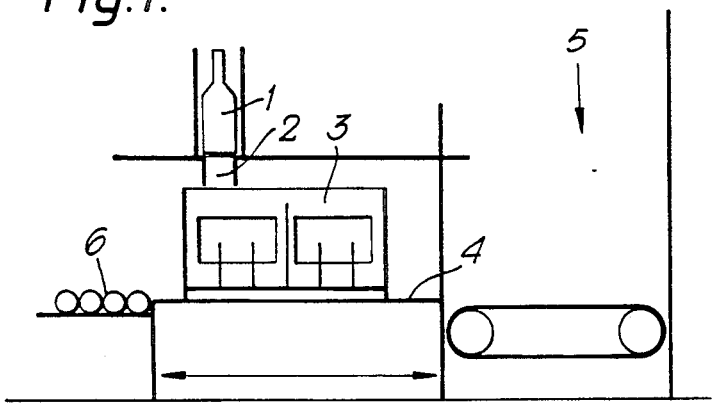
FIG. 1 illustrates the general principle of the present invention.

FIG. 1 illustrates a bottle 1 which is to be fed through a chute 2 and into a crate 3, said crate being positionable on a table 4 which is indexable in x and y horizontal directions. In the preferred embodiment, a crate stack chute 5 is linked with said movable table 4.

When the crate 3 is completely filled with properly positioned bottles 1 therein, the filled crate is shifted to a receiving station 6, e.g. constituted by rollers.

Figure 2:
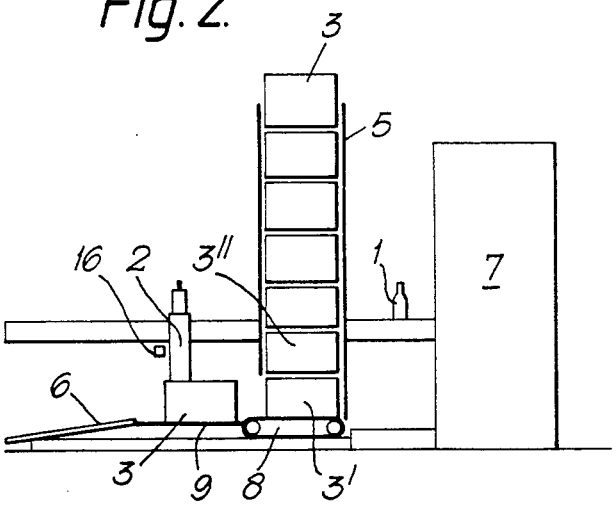
FIG. 2 is a slightly more detailed version of the embodiment in the FIG. 1.

In FIG. 2, bottles are collected from a customer by means of a bottle receiving and redemption apparatus 7. The crate stack chute 5 is filled with crates 3, and it is noted that the bottom crate, labelled 3' is slightly shifted to the left in the drawing figure in order to avoid interlocking between the crate 3'' immediately above. Forwarding means 8 are provided for moving the crate 3' into the position of the crate 3 to the left thereof in the drawing figure, whereupon crate 3'' will drop to enter the position which the crate 3' previously had.

Crate 3 is located on a table 9 which is movable in horizontal x and y directions, i.e. in two directions. The table, as will be further illustrated in the subsequent drawing figures, has suitably an inlet and an outlet, as well as sides, in order to guide a crate 3 properly into position thereon.

From FIG. 3 it will be noted that the apparatus 7 is located at an end of a conveyor 10 in order to feed out bottles which are delivered by a customer to the apparatus 7. As further noted from FIG. 3, the bottles which have been delivered by the customer are of varying diameter, and some of the bottles delivered by the apparatus 7 are suitable for one handling station 11, whereas other bottles are suitable for handling at other handling stations (not shown).

As will be further explained hereinafter, the bottles which are delived by the apparatus 7 have been recognized with regard to type, dimensions, colour etc. Thus, station 11 will count the bottles as they pass and pick off the proper bottle from the conveyor 10 by means of gate means 12, said bottle then to be further processed by the handling station 11. Said gate means 12 gate the bottles into a proper bay 13. It should be properly noted that the conveyor 10 also extends into the bay 13, in order to enable the present device to operate with a single conveyor 10 both along the general path of conveyance, as well as along said bay 13. At the end of bay 13, there is located a reciprocally movable pusher means 14 capable of inhibiting movement of bottles in bay 13 when pushing on bottles in a further bay 15. The rightmost bottle 1' will, upon the pushing action from pusher means 14, be pushed into a chute 2, as illustrated in FIG. 1 and 2. Detector means 16 are located adjacent said chute 2 in order to detect when an article such as a bottle passes through said chute.

In order to fully appreciate how said table means 9 with a crate 3 located thereon operates for positioning of bottles fed into the crate 3 through said chute 2, reference is now made to FIG. 4*a*, illustrating a crate for 12 bottles. With respect to chute 2, table means 9 is movable to positions x1, x2, x3, x4 and x5 in x-direction, and positions y1, y2, y3, y4 and y5 in y-direction, thus creating a possibility of 12 coordinates as indicated in table I below.

TABLE I

| 12 bottles crate | |
|---|---|
| Step | Compartment ref. |
| 1 | x1 y2 |
| 2 | x1 y4 |
| 3 | x2 y5 |
| 4 | x2 y3 |
| 5 | x2 y1 |
| 6 | x3 y3 |
| 7 | x3 y5 |
| 8 | x4 y1 |
| 9 | x4 y3 |
| 10 | x4 y5 |
| 11 | x5 y2 |
| 12 | x5 y2 |

In case of a 24 bottle crate as in FIG. 4*b*, there are created 24 coordinates as in TABLE II below, based on the table means 9 being movable, with respect to chute 2, to positions x1, x2, x3, x4, x5 or x6 in the x direction, and y1, y2, y3 or y4 in the y direction.

TABLE II

| Step | 24 bottles crate Compartment ref. |
|---|---|
| 1 | x1 y1 |
| 2 | x1 y2 |
| 3 | x1 y3 |
| 4 | x1 y4 |
| 5 | x2 y4 |
| 6 | x2 y3 |
| 7 | x2 y2 |
| 8 | x2 y1 |
| 9 | x3 y1 |
| 10 | x3 y2 |
| 11 | x3 y2 |
| 12 | x3 y4 |
| 13 | x1 y4 |
| 14 | x4 y3 |
| 15 | x4 y2 |
| 16 | x4 y2 |
| 17 | x5 y1 |
| 18 | x5 y2 |
| 19 | x5 y3 |
| 20 | x5 y4 |
| 21 | x6 y4 |
| 22 | x6 y3 |
| 23 | x6 y2 |
| 24 | x6 y1 |

Table I and II illustrate the examples of a crate containing 12 and 24 bottles, respectively, where the compartment reference is indicated. The crate is filled preferably in the series of steps indicated, with reference to the corresponding compartment references. Thus, the table means 9 is moved with reference to the chute 2, and the various compartment references are thus those references on the table (or the crate 3) into which a bottle is to be entered.

With reference to FIG. 5, a bottle 1 has entered bay 13 whereas a further bottle 17 passes the handling station 11 by means of the conveyor 10 to enter into a collection bay at a possible subsequent handling station (not shown) down the path of conveyance. Further, detector means 18 provides counting of bottles delivered from apparatus 7 and once the correctly identified bottle in a series is detected by counter and detector 18, a gate means flap 19 on said gate means 12 moves out (to the right in FIG. 5) by means of a reciprocally operating drive 20. As soon as bottle 1 has entered into the entrance of bay 13, flap 19 moves back to the right in order that bottle 17 may pass station 11. Bottles which have previously entered bay 13 are, in FIG. 5, shown to have entered a further bay 15 at right angles to bay 13. As will more clearly appear from FIG. 6, at the end of bay 13 and at the beginning of bay 15 there is located reciprocally operative pusher means 14, as briefly explained in connection with FIG. 3. Said pusher means includes an L-shaped pusher member 14', so designed as to push on bottles in bay 15 while simultaneously inhibiting movement of bottles 1 from bay 13 into bay 15 due to part of member 14' barring the entrance to bay 15 from bay 13. Again, it will be noted, that the single conveyor 10 conveys bottles in bay 13 as well as those bottles which simply pass station 11.

Bay 15 has at an end thereof an exit hole 15' leading to said chute 2, as previously and further to be explained.

In an automatic device like the present one, it is important that not only bottles which are to fill crates are supplied, but also that the crates themselves are suppliable.

For that purpose, a crate stack chute 5, as in FIG. 1-3, has been provided. Chute 5 has at an end thereof, and in a preferred embodiment thereof, two resilient pusher members 21 operating in the following manner. When a crate 3'' is to drop into the position of the lowermost crate 3' as the latter is removed from the chute 5, it will follow approximately the path of movement illustrated at the bottom of FIG. 8. It should, however, be noted first of all that the front of the chute 5, as illustrated in FIG. 9, has an opening 22, the width of which is corresponding to the width of the crate to be delivered from the chute 5, and a height which is larger than the height of a crate. This implies, as clearly demonstrated in FIG. 8, that the crate 3'', when dropping down to the position of crate 3', will have a first state 23 in which the forward end of the crate is no longer fully retained by chute 5, because the opening 22 thereof has a height dimension exceeding that of the crate itself. Thus it is seen from FIG. 8 that the crate in fact tilts with the forward bottom end 24 in a forward direction, simultaneously with the rear end 25 of the crate dropping down and being pushed slightly forward by the pushing members 21.

This in turn implies that engagement between the upper end of the crate 3' and the lower end of crate 3'' is no longer existent, which in turn also means that forwarding means 26 in the form of pushing blocks will be able, upon request, to push the bottommost crate 3' out of the chute 5 against the force of retainment means 27, in the example of FIGS. 9 and 10 in the form of a spring loaded flap. Flap 27 is for preventing crate 3' from coming to far out of chute 5 until the crate is actually called for when a previous crate has been fully filled with bottles.

Instead of said flap 27, said retainment means could e.g. be in the form of springs 28 engaging an edge of a side opening 29 of the crate.

The pushing blocks 26 are motor driven and act via a pair of chains 30.

As shown in FIGS. 11 and 12, it will be noted that a crate 31 has been completely filled and has been pushed off table 9 by means of a further crate 32. A motor 33 enables table 9 to move table 9 in y direction via a gear 34. A motor 35 enables table 9 to move in x direction by means of a gear 36 The gears 34 and 36 operate chains 37 and 38, respectively. Chain 37 is connected to the table proper 9, whereas chain 38 is connected to a platform 39 on which the motor 33 and gear 34 are located. In order to preserve a rectilinear motion by means of said chains 37, 38, rods 40 and 41 are provided, slideably engaging slide shoes 42.

Thus, controlling of the motors 33 and 35 in steps enable table 9 to move to proper x, y coordinates relative to the shaft 2.

It is important to correctly position the table 9 with the crate thereon in order that bottles, in the example described, drop into their proper positions. Therefore, a detector 43 may suitable be located so as to detect when a marking 44 is opposite thereto, detection of the marking 44, which itself is the crate wall seen through hole 44' indicating that the crate is present and has been properly located on the table. In the state of no crate on table 9, light emitted from detector 43 will pass through hole 44' of the adjacent table wall, hole 44'' on the opposite wall and be reflected back by reflector 61.

With a crate divided into compartments, as illustrated in FIGS. 11 and 12 as well as in FIG. 4, it is important to recognize that the chute 2 must at any time be properly located above the proper compartment or area (if no positions in the crate) defined by the respective coordinates.

In order to enable such positioning and also a stalling of the motors, in the example shown, the platform 39 is, on its bottom side, provided with an x location member 45 having indentations 46 coacting with inductance sensors or photosensors 47. Thus, when platform 39 moves relative to the stationary foundation 48 along rods 49 (of which only one is indicated in FIG. 15) the indentations 46 will be counted by the sensors 47, said counting representing counting to the desired x-y coordinate of the table relative to the chute 2. Similarly, a y-location member 60 is located on the bottom side of the table 9 and is provided with indentations (not shown) detectable by inductance sensors or photosensors 59.

Thus, with reference to the x-coordinate, when location member 45 moves the stationary sensor 47 will detect the passing from one indentation 46 to the next, thus representing a step or indexing of the platform 39. Thus, when sensor 47 detects an indentation 46, an immediate stalling of the motor 35 will be effected.

Although indentations 46 are shown, alternative types of position marking are possible.

In order to avoid jamming, it is necessary to have a detector means 16 attached to the chute 2. In the embodiment shown in FIG. 16, said detector 16 may be of an electro-mechanical switch type which is in particular suitable for heavier articles, such as bottles of glass. However, with bottles made of plastics, such bottles may be too light, and photoelectric means may in such event replace the electro-mechanical device 16.

Experience has shown that too high speed of an article, such as bottle hitting the bottom of a crate, could very easily cause the bottle to bounce off the bottom of the crate and overturn inside the crate, thus causing Jamming.

In order to overcome such deficiency, it is important to provide along chute 2 a controllable retardation through friction wheels 50 and 51. The wheels are controlled by respective motors 52 and 53. Thus, when a bottle (not shown in FIGS. 17 and 18) is dropped through chute 54 (which in this particular case is shown circular in cross section), soft friction wheels 50, 51 will engage the sides of the bottle and by means of the motors 52 and 53 controllably move the bottle further down at a controlled low speed which ensures that the bottle will not to a substantial degree bounce off the bottom of the crate.

Such retardation means 50–53 are important also for positively driving the article or bottle through the chute 2.

For sake of clarity, the retardation wheels 50 and 51 with associated motors 52 and 53 are not illustrated in FIGS. 13 and 14, nor in any of the other drawing figures which include chute 2.

As will appear from the drawing FIGS. 13 and 14, when the filled up crate, as seen in FIG. 14, is pushed out by an empty crate, the table 9 has a ramp 55 enabling the crate to slide down onto slide rails 56 and onto rollers 6.

FIG. 19 illustrates in block schematic form the overall system, according to the invention.

FIG. 19 is described in connection with the handling of bottles and crates, although it will be appreciated that other types of articles may be used with the present invention as defined. Bottles are fed by a customer into a bottle receiving and redemption apparatus 7. Said apparatus 7 cooperates with detector 18 which is capable of detecting whenever a correct bottle reaches the detector, and the detector causes gate 12 to open in order to give access to the bottle into bay 13.

If chute detector 16 detects a jamming of a bottle inside the chute or the major passing of a bottle, the detector 16 makes an input to a central processing unit 57. If the chute detector 16 indicates to the central processing unit 57 any malfunction, pusher means 14 will halt its operation, i.e. causing no further bottles to be fed into the chute 2 until the error is corrected, and thus also effectively preventing any bottles in bay 13 from entering bay 15.

However, if the operation is normal, the chute detector 16 will detect every bottle passing through the chute 2 and proper counting in the central processing unit 57 will initiate the x/y motors 35, 33 to move table 9 as indicated. Also, the central processing unit 57 causes motor means located at the rear of the chute 5 and labelled 58 in FIG. 7 to cause the bottommost crate in a stack to be moved away from the stack. Whenever motor 58 has carried out a number of turns to move a crate away from the stack, its operation will halt.

The x- and y-position detectors 47 and 59 for properly determining the position of table 9 and controlling the motors 35 and 33 are connected to said central processing unit.

In FIG. 20 is shown a means 62 for reducing substantially rattling noise from moving crates when removing the lowermost crate 63 and shifting the other crates 64, 65, 66 in the stack downward. Said means 62 is constituted by an arm 67 which is turned about a pivot 68 from a horizontal position as shown in dotted line 60 to the inclined position shown in solid line. The arm is capable of controllably, e.g. by motor means (not shown), shifting the stack of crates downward. The arm 67 suitably starts moving when the crate 63 is halfway out of the stack chute 69.

Having described our invention, we claim:

1. A device for positioning of articles in a box or crate means comprising, a) a table means indexable in two horizontal directions x and y, said box or crate means being positionable on said table means, b) drive means for selectively indexing said table means, c) means for forwarding the articles to chute means located above said box or crate means when on said table means, d) means for positioning by indexing said table means so as to locate said chute means above a first x,y coordinate of said table means, e) means for selectively feeding an article through said chute means to position said article in said box or crate means below said chute means, wherein said chute means has means capable of delivering articles from said chute means at a predetermined speed, and wherein said means capable of delivering articles comprises a pair of motor controlled soft friction wheels extending with a section thereof into said chute means, f) means for positioning by indexing said table means so as to locate said chute means above a further x,y coordinate of said table means, and g) means for selectively feeding further articles through said chute means to position said articles in said box or crate means below said chute means at respective x,y coordinates of said table means until said box or crate is properly filled with said articles.

2. A device for positioning of articles in a box or crate means comprising, a) means for holding a stack of boxes or crate means, b) means for dislocating and removing a bottom box or crate means from said stack, c) means for forwarding said removed box or crate means to table means being indexable in two horizontal directions x and y, said box or crate means being positionable on said table means, d) drive means for selectively indexing said table means, e) means for forwarding the article to chute means located above said box or crate means when on said table means, f) means for positioning by indexing said table means so as to locate said chute means above a first x,y coordinate of said table means, g) means for selectively feeding an article through said chute means to position said article in said box or crate means below said chute means, h) means for positioning by indexing said table means so as to locate said chute means above a further x,y coordinate of said table means, and i) means for selectively feeding further articles through said chute means to position said articles in said box or crate means below said chute means at respective x,y coordinates of said table means until said box or crate is properly filled with said articles, and wherein said means for holding comprises a stack chute, said stack chute having at a rear end thereof, dislocating and pushing members acting on a box or crate means rear wall when said box or crate means drops from a position above a further box or crate means below which is removed from the stack bottom in order to enable said box or crate means to enter the stack bottom position previously held by said further box or crate means, and out of horizontally locking engagement with another box or crate means located above, and said stack chute having at a front end thereof an opening so wide and high as to cause said box or crate means in so dropping to tilt with its forward bottom part in a forward direction simultaneously with pushing action of said members, and further having drive means for engaging a rear end of said box or crate means for selective removal thereof from said stack chute, and wherein said stack holding means includes arm means engagable with a bottom side of a box or crate means to be lowered down to a bottom position in said stack holding means for controllably lowering such box or crate means, said arm being pivotably connected to a bottom section of said stack holding means.

3. A device for positioning of articles in a box or crate means comprising, a) means for holding a stack of boxes or crate means, b) means for dislocating and removing a bottom box or crate means from said stack, c) means for forwarding said removed box or crate means to table means being indexable in two horizontal directions x and y, said box or crate means being positionable on said table means, d) drive means for selectively indexing said table means, e) means for forwarding the article to chute means located above said box or crate means when on said table means, f) means for positioning by indexing said table means so as to locate said chute means above a first x,y coordinate of said table means, g) means for selectively feeding an article through said chute means to position said article in said box or crate means below said chute means, h) means for positioning by indexing said table means so as to locate said chute means above a further x,y coordinate of said table means, and i) means for selectively feeding further articles through said chute means to position said articles in said box or crate means below said chute means at respective x,y coordinates of said table means until said box or crate is properly filled with said articles, and wherein said chute means has means capable of delivering articles from said chute means at a predetermined speed, and wherein said means capable of delivering articles comprises a pair of motor controlled soft friction wheels extending with a section thereof into said chute means.

4. A device for positioning of articles in a box or crate means comprising, a) a table means indexable in two horizontal directions x and y, said box or crate means being positionable on said table means, b) drive means for selectively indexing said table means, c) means for recognizing an identity of an article, d) conveyor means for forwarding said article to selective gate means, e) means for forwarding said article from said gate means to chute means located above said box or crate means when on said table means, f) means for positioning by indexing said table means so as to locate said chute means above a first x,y coordinate of said table means, g) means for selectively feeding an article through said chute means to position said article in said box or crate means below said chute means, h) means for positioning by indexing said table means so as to locate said chute means above a further x,y coordinate of said table means, i) means for selectively feeding further articles through said chute means to position said articles in said box or crate means below said chute means at respective x,y coordinates of said table means until said box or crate is properly filled with said articles, j) means for holding a stack of boxes or crate means, k) means for dislocating and removing a bottom box or crate means from said stack, l) means for forwarding said removed box or crate means to said table means, and wherein said means for holding comprises a stack chute, said stack chute having at a rear end thereof, dislocating and pushing members acting on a box or crate means rear wall when said box or crate means drops from a position above a further box or crate means below which is removed from the stack bottom in order to enable said box or crate means to enter the stack bottom position previously held by said further box or crate means, and out of horizontally locking engagement with another box or crate means located above, and said stack chute having at a front end thereof an opening so wide and high as to cause said box or crate means in so dropping to tilt with its forward bottom part in a forward direction simultaneously with pushing action of said members, and further having drive means for engaging a rear end of said box or crate means for selective removal thereof from said stack chute, and wherein said stack holding means includes arm means engagable with a bottom side of a box or crate means to be lowered down to a bottom position in said stack holding means for controllably lowering such box or crate means, said arm being pivotably connected to a bottom section of said stack holding means.

5. A device for positioning of articles in a box or crate means comprising, a) a table means indexable in two horizontal directions x and y, said box or crate means being positionable on said table means, b) drive means for selectively indexing said table means, c) means for recognizing an identity of an article, d) conveyor means for forwarding said article to selective gate means, e) means for forwarding said article from said gate means to chute means located above said box or crate means when on said table means, f) means for positioning by indexing said table means so as to locate said chute means above a first x,y coordinate of said table means, g) means for selectively feeding an article through said chute means to position said article in said box or crate means below said chute means, h) means for positioning by indexing said table means so as to locate said chute means above a further x,y coordinate of said table means, and i) means for selectively feeding further articles through said chute means to position said articles in said box or crate means below said chute means at respective x,y coordinates of said table means until said box or crate is properly filled with said articles, and wherein said chute means has means capable of delivering articles from said chute means at a predetermined speed, and wherein said means capable of delivering articles comprises a pair of motor controlled soft friction wheels extending with a section thereof into said chute means.

6. A device for handling packages such as boxes and crates, comprising means for holding a stack of boxes or crate means, and means for dislocating and removing a bottom box or crate means from said stack, wherein said means for holding comprises a stack chute, said stack chute having at a rear end thereof dislocating and pushing members acting on a box or crate means rear wall when said box or crate means drops from a position above a further box or crate means below which is removed from the stack bottom in order to enable said box or crate means to enter the stack bottom position previously held by said further box or crate means, and out of horizontally locking engagement with another box or crate means located above, and said stack chute having at a front end thereof an opening so wide and high as to cause said box or crate means in so dropping to tilt with its forward bottom part in a forward direction simultaneously with pushing action of said members, and further having drive means for engaging a rear end of said box or crate means for selective removal thereof from said stack chute, and wherein said stack holding means includes arm means engagable with a bottom side of a box or crate means to be lowered down to a bottom position in said stack holding means for controllably lowering such box or crate means, said arm being pivotably connected to a bottom section of said stack holding means.

* * * * *